US006706341B1

(12) United States Patent
Schnitzel et al.

(10) Patent No.: US 6,706,341 B1
(45) Date of Patent: Mar. 16, 2004

(54) HIGH OPACITY WHITE THERMAL TRANSFER RIBBONS CONTAINING GLASS PARTICLES

(75) Inventors: Susan R. Schnitzel, Lancaster, NY (US); LuAnn G. Saden, Fredonia, NY (US)

(73) Assignee: International Imaging Materials Inc., Amherst, NY (US)

( * ) Notice: Subject to any disclaimer, the term of this patent is extended or adjusted under 35 U.S.C. 154(b) by 23 days.

(21) Appl. No.: 09/849,083

(22) Filed: May 4, 2001

Related U.S. Application Data

(63) Continuation-in-part of application No. 09/586,467, filed on Jun. 3, 2000, now abandoned.

(51) Int. Cl.[7] ..... B41M 5/30

(52) U.S. Cl. ..... 428/32.69; 428/32.71; 428/32.77

(58) Field of Search ..... 428/195, 325, 428/328, 32.69, 32.71, 32.77

(56) References Cited

U.S. PATENT DOCUMENTS

| | | | | |
|---|---|---|---|---|
| 5,776,280 A | | 7/1998 | Puckett et al. | |
| 5,891,552 A | * | 4/1999 | Lu et al. | 101/487 |
| 5,972,480 A | * | 10/1999 | Yoshikawa et al. | 156/232 |
| 6,228,486 B1 | * | 5/2001 | Kittel et al. | 427/152 |

* cited by examiner

*Primary Examiner*—B. Hamilton Hess
(74) *Attorney, Agent, or Firm*—Howard J. Greenwald

(57) ABSTRACT

A thermal transfer ribbon with an effective contrast ratio of at least about 87 percent and a brightness of at least about 70. The ribbon contains a flexible substrate and, disposed over the substrate, at least one coating containing from about 45 to about 90 weight percent of titanium dioxide and from about 0.05 to about 20 weight percent of glass particles. This coating has a coat weight from about 3 to about 20 grams per square meter.

22 Claims, 8 Drawing Sheets

HIGH OPACITY WHITE THERMAL TRANSFER RIBBONS CONTAINING GLASS PARTICLES

CROSS-REFERENCE TO RELATED PATENT APPLICATION

This application is a continuation-in-part of applicants' patent application U.S. Ser. No. 09/586,467, filed on Jun. 3, 2000, now abandoned.

FIELD OF THE INVENTION

A thermal transfer ribbon containing a substrate, a pigmented layer, titanium dioxide, and glass. A multiplicity of glass particles are dispersed within at least one of the layers of the ribbon.

BACKGROUND OF THE INVENTION

Thermal transfer ribbons are well known to those skilled in the art. Thus, for example, U.S. Pat. No. 5,776,280 discloses a ribbon comprised of a polyester substrate, an intermediate layer of pigmented wax contiguous with the polyester substrate, and a top ink layer.

When a thermal transfer ribbon, such as the thermal transfer ribbon disclosed in U.S. Pat. No. 5,776,280, is used to print on a dark surface, the dark color of the surface being printed sometimes shows through. This "show through" phenomenon is commercially unacceptable, causing an image which is unattractive. Furthermore, the combination of the color of the surface being printed upon and the color of the image layer being transferred often produces colors not desired.

One solution offered by the prior art was to make the pigmented layer on the ribbon thicker so that more pigment would be transferred and thus would do a better job of hiding the color of the surface being printed upon. However, increasing the thickness of the pigmented layer often produced ribbons with poor adhesion of such layer to the polyester, flaking of the pigmented layer, and consequent poor print quality.

Another solution offered by the prior art was to maintain the thickness of the pigmented layer but to increase the concentration of pigment within such layer. This solution, although it often led to a more opaque printed job, also often produced a printed layer which was not durable, suffering from chalkiness; such a layer often was easily abraded.

It is an object of this invention to provide a novel thermal transfer ribbon which produces a printed product which is economical, durable, substantially non-flaking, and substantially opaque.

SUMMARY OF THE INVENTION

In accordance with this invention, there is a provided a thermal transfer ribbon with an effective contrast ratio of at least about 87 percent and a brightness of at least about 70, wherein said thermal transfer ribbon is comprised at least one coating disposed on such substrate, and wherein said coating is comprised of from about 45 to about 90 weight percent of titania with a particle size of from about 0.1 to about 1.0 microns and from about 0.05 to about 20 weight percent of glass particles with a particle size smaller than about 15 microns.

BRIEF DESCRIPTION OF THE DRAWINGS

The invention will be described by reference to this specification and to the enclosed drawings, in which like numbers refer to like elements, and in which.

DESCRIPTION OF THE PREFERRED EMBODIMENTS

In the first section of this specification, one embodiment of the invention will be claimed by reference to FIGS. 1 through 6. In the second section of this specification, a second embodiment of the invention will be described by reference to FIGS. 7 and 8.

Figure 1:
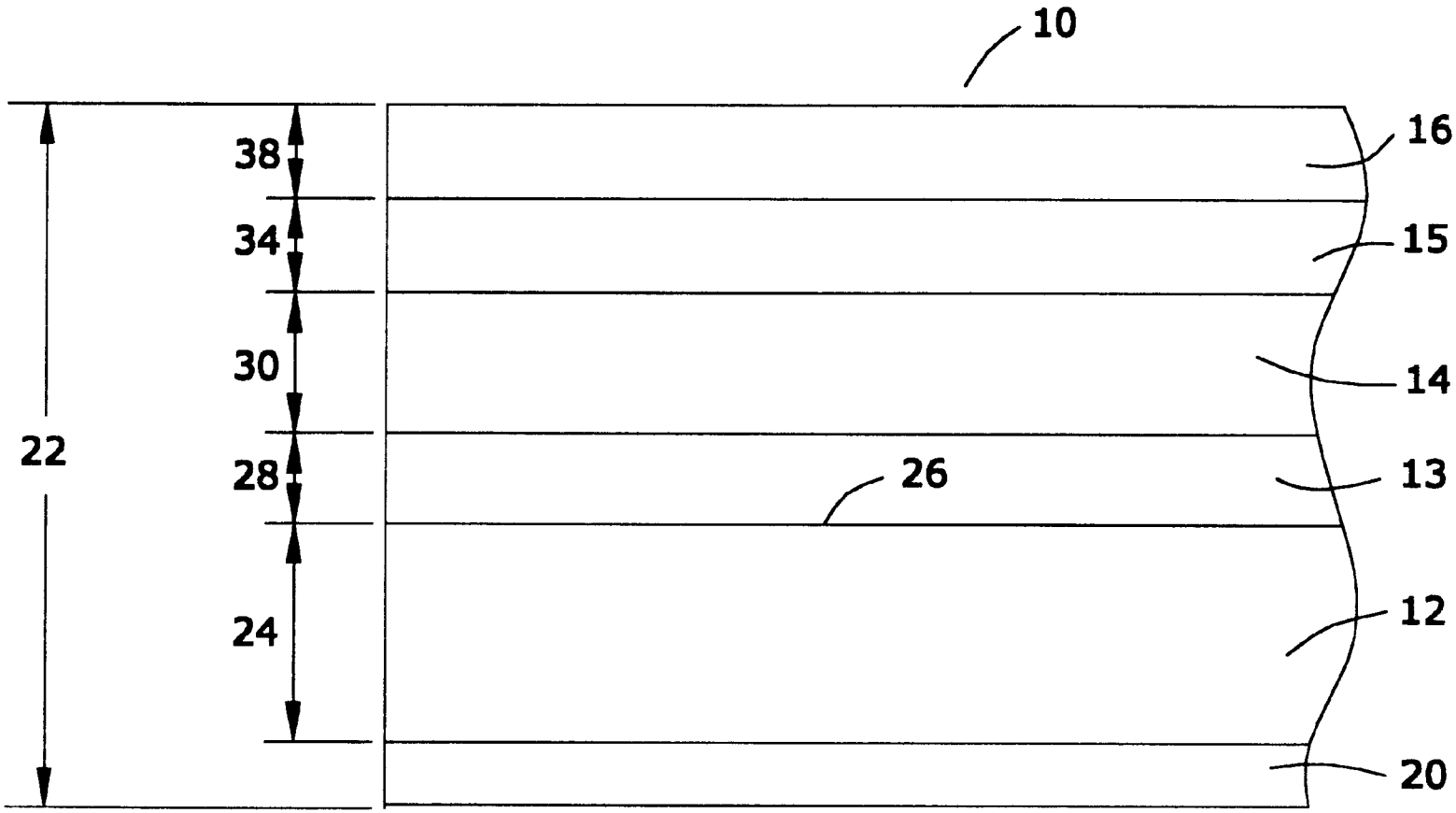
FIG. 1 is a sectional view of one preferred thermal ribbon of this invention.

FIG. 1 is a sectional view of a thermal transfer ribbon 10 which is comprised of a substrate 12, a pigmented layer 14 overlaying the substrate 12, and an opacification layer 16 overlaying the pigmented layer 14. One may optionally include a release layer 13 between the substrate 12 and the pigmented layer 14, and/or one may optionally include a tie layer 15 between the pigmented layer 14 and the opacification layer 16. A backing layer 20 is contiguous with and on the opposite side of the substrate 12. These layers, and their properties, are described in more detail below.

Referring again to FIG. 1, it is preferred that transfer ribbon 10 have a thickness 22 less than about 20 microns and, preferably, less than about 15 microns.

The substrate 12 may be any substrate typically used in thermal transfer ribbons such as, e.g., the substrates described in U.S. Pat. No. 5,776,280; the entire disclosure of this patent is hereby incorporated by reference into this specification.

In one embodiment, substrate 12 is a flexible material which comprises a smooth, tissue-type paper such as, e.g., 30–40 gauge capacitor tissue. In another embodiment, substrate 12 is a flexible material consisting essentially of synthetic polymeric material, such as poly(ethylene terephthalate) polyester with a thickness of from about 1.5 to about 15 which, preferably, is biaxially oriented. Thus, by way of illustration and not limitation, one may use polyester supplied by the Toray Plastics of America (of 50 Belvere Avenue, North Kingstown, R.I.) as catalog number F53.

Referring again to FIG. 1, and in the preferred embodiment depicted therein, it will be seen that substrate 12 preferably has a thickness 24 of from about 3 to about 6 microns.

One may optionally utilize a release layer 13 and make it contiguous with the top surface 26 of the substrate 12. The release layer 13, when used, facilitates the release of pigmented layer 14 from substrate 12 when thermal ribbon 10 is used to print at high temperatures.

Release layer 13 preferably has a thickness 28 of from about 0.2 to about 2.0 microns and typically is comprised of at least about 50 weight percent of wax. Suitable waxes which may be used include carnuba wax, rice wax, beeswax, candelilla wax, montan wax, paraffin wax, mirocrystalline waxes, synthetic waxes such as oxidized wax, ester wax, low molecular weight polyethylene wax, Fischer-Tropsch wax, and the like. These and other waxes are well known to those skilled in the art and are described, e.g., in U.S. Pat. No. 5,776,280.

In one embodiment, at least about 75 weight percent of layer 13 is comprised of wax. In this embodiment, the wax used is preferably carnuba wax. Minor amounts of other materials may be present in layer 13. Thus, one may include from about 5 to about 20 weight percent of heat-softening resin that softens at a temperature of from about 60 to about 150 degrees Celsius. Some suitable heat-softening resins include, e.g., the heat-meltable resins described in columns 2 and of U.S. Pat. No. 5,525,403, the entire disclosure of which is hereby incorporated by reference into this specification. In one embodiment, the heat-meltable resin used is polyethylene-co-vinylacetate with a melt index of from about 40 to about 2500 dg. per minutes.

Referring again to FIG. 1, and in the preferred embodiment depicted therein, the layer 13 may be omitted and the layer 14 may be directly contiguious with substrate 12. Further, it will be seen that pigmented layer 14 has a thickness 30 of from about 2 to about 20 grams per square meter and, preferably, from about 4 to about 7 grams per square meter. In one embodiment, the pigmented layer 14 represents from about 4.5 to about 6 grams per square meter of the weight of ribbon 10. When used in this specification, the term "microns" is often equivalent to "grams per square meter" at a density of 1.0 gram per cubic centimeter.

It should be noted that the amount of pigmented layer used in the instant invention is substantially less than that used in some of the prior art. Thus, e.g., U.S. Pat. No. 5,776,280 discloses that " . . . coating weights for the thermal transfer material on substrate 22 preferably range from 7.75 to 23.25 . . . " grams per square meter. By comparison, it is generally preferred to use from about 2 to about six grams per square meter of pigmented material in the transfer ribbon 10 of this invention. In general, subject to some of the exceptions described below, the pigmented layer 14 may be any of the "color ink layers" described in U.S. Pat. No. 5,525,403, the entire disclosure of which is hereby incorporated by reference into this specification. Thus in general, the pigmented layer 14 is comprised of colorant, wax, and heat-softenable resin.

The pigmented layer 14 comprises from about 10 to about 90 weight percent, by dry weight, of colorant and, preferably, from about 50 to about 75 weight percent, by dry weight, of colorant. In one embodiment, from about 60 to about 75 weight percent of colorant, by dry weight of pigmented layer 14, is used.

One may use any of the pigments conventionally used in the art for the colorant. Thus, e.g., referring again to U.S. Pat. No. 5,525,403 (whose disclosure is incorporated by reference into this specification), one may use inorganic pigments, organic pigments, fluorescent pigments, white pigments (titanium dioxide, calcium carbonate, etc.), yellow pigments, red pigments, blue pigments, other suitably colored pigments, and the like.

In one preferred embodiment, the pigment used is titanium dioxide (also referred to as titania). In this embodiment, the titanium dioxide used preferably has an average particle size of from about 0.15 to about 1.0 microns (and preferably from about 0.2 to about 0.4 microns) and a refractive index of at least 2.2; one may purchase titanium dioxide with these properties in the "rutile" form. Applicants have discovered that, unexpectedly, unless the titanium dioxide particles have the desired particle size distribution, the printed product produced by the thermal ribbon does not have the desired visual properties.

It should be noted that the titanium dioxide used in the embodiment of FIGS. 1–6 is not necessarily the same as the titanium dioxide used in the embodiment of FIG. 8.

In addition to the titanium dioxide, the pigmented layer also is comprised of from about 2 to about 10 weight percent, by dry weight, of one or more of the waxes described elsewhere in this specification. It is preferred to use carnuba wax in one embodiment.

In addition to the titanium dioxide and the wax, one also should use from about 15 to about 60 weight percent, by dry weight of a heat-softenable resin which, in combination with the wax, acts as a binder. Some of the heat-softenable resins which may be used as referred to as "heat-meltable resins" in U.S. Pat. No. 5,525,403 and include, e.g., polyester resins, polyurethane resins, ethylene vinyl acetate copolymers, vinyl chloride—vinyl acetate copolymers, polyvinyl butyrals, polymethyl methacrylates, polyethylenemethacrylic acid ester copolymers, polystyrene, polystyrene—polybutadiene copoloymers, and the like.

In one embodiment, in addition to the titanium dioxide pigment, one may also use from about 1 to about 40 percent, by dry weight of the pigmented layer, of one or more extending agents; preferably, from about 5 to about 15 weight percent of such extending agent is used, by dry weight. The function of such extending agent is to provide optimum spacing between the particles of the pigment so that maximum light scattering effects will occur. To achieve this end, extending agents such as barium sulfate, calcium carbonate, aluminum silicate, mica, and the like may be used. These extending agents preferably have an average particle size less than 5.0 microns (and, more preferably, less than 1 micron) and, furthermore, are preferably inorganic.

In one embodiment, the extending agent used is borosilicate glass flux sold as "APEC 9630".

In one embodiment, a polymethyl methacrylate (PMMA) with a glass transition temperature of about 105 degrees Celsius and a weight average molecular weight of 95,000 is used; this reagent may be purchased from Dianal America company of Texas as "Dianal BR 80." Other polymethylmethacrylates with weight average molecular weights ranging from about 25,000 to about 500,000 also may be used.

Applicants have discovered that the use of PMMA in the pigmented layer 14 not only provides a printed product with good abrasion resistance, but also provides a printed product with excellent resistance to ultraviolet light degradation.

One may optionally also include from about 0.25 to about 15 weight percent, by dry weight, of a plasticizing agent. Thus, by way of illustration and not limitation, one may use one or more of the plasticizers disclosed in U.S. Pat. No. 5,776,280 including, e.g., adipic acid esters, phthalic acid esters, chlorinated biphenyls, citrates, epoxides, glycerols, glycol, hydrocarbons, chlorinated hydrocarbons, phosphates, and the like.

In one preferred embodiment, the plasticizer is an ester of phthalic acid such as, e.g., di-2-ethylhexylphthalate.

One may also optionally include from about 0.5 to about 4.0 weight percent, by dry weight, of dispersing agent, provided that the ratio of dispersing agent/colorant is from about 0.001 to about 2.0. One may use any of the conventional dispersing agents such as anionic dispersing agents, cationic dispersing agents, and nonionic dispersing agents. In one embodiment, a nonionic dispersing agent (such as "SOLSPERSE 24000" made by the Avecia Company of England) is used.

Referring again to FIG. 1, it is preferred that the pigmented layer 14 have a melt softening point in the range of from about 60 to about 130 degrees Centigrade and a melt viscosity, at 150 degrees Celsius, of from about 1,000 centipoise to about 100,000 centipoise.

In one embodiment, the pigmented layer 14 is comprised of an optical brightener such as, e.g., fluorescent brighteners. Many of these fluorescent brighteners are sold by the Clariant Corporation of Charlotte, N.C. under the tradenames of "LEUCOPURE," "CARTAX," "LEUCOPHOR" (a stilbene brightener), etc.

As is known to those skilled in the art, whitening agents, optical whiteners, and/or brightening agents are preferably fluorescent materials that convert some of the ultraviolet of sunlight into visible light. Some of these materials include 1,3,5-triazine derivatives, methyl dimethyl aminocoumarin, tiazinyl diaminostilbene disulfonic acid, etc. These materials are described e.g., on page 495 of "Brady' Materials Handbook," Thirteenth Edition; and they are well known to those in the art.

Referring again to FIG. 1, one may optionally use a tie layer 15, whose function is to improve the adhesion between the pigmented layer 14 and the opacification layer 16 during thermal transfer printing. This, tie layer 15 need not invariably be used. The tie layer 15 has a thickness 34 of from about 0.1 to about 2.0 microns, and a coating weight of from about 0.1 to about 2.0 grams per square meter.

One may use polyester resins or polyurethane resins as tie layer 34. Thus, referring to U.S. Pat. No. 5,525,403, one may use a composition prepared by dissolving 90 parts by weight of polyester resin and 10 parts by weight of silica powder in a mixed solvent of methyl ethyl ketone(2-butanone) and toluene and thereafter drying such material. Alternatively, one may use a similar composition that does not contain the silica.

It is preferred to omit tie layer 15 and bond opacification layer 16 directly to pigmented layer 14. Referring to FIG. 1, it will be seen that opacification layer 16 has a thickness 38 of from about 0.5 to about 4.0 microns, corresponding to a coating weight of from about 0.5 to about 4.0 grams per square meter.

The opacification layer 16 generally contains from about 15 to about 90 weight percent, by total dry weight of layer 16, of binder. The term "dry weight," as used in this specification, refers to the weight of materials when they contain less than about 0.1 by weight of solvent.

The binder used in layer 16 preferably has a softening point from about 45 to about 150 degrees Celsius and a multiplicity of polar moieties such as, e.g., carboxyl groups, hydroxyl groups, chloride groups, carboxylic acid groups, urethane groups, amide groups, amine groups, urea, epoxy resins, and the like. Some suitable binders include polyester resins, bisphenol-A polyesters, polyvinyl chloride, copolymers made from terephthalic acid, polymethyl methacrylate, vinylchloride/vinylacetate resins, epoxy resins, nylon resins, urethane-formaldehyde resins, polyurethane, mixtures thereof, and the like.

In one embodiment a mixture of two synthetic resins is used. Thus, e.g., one may use a mixture comprising from about 40 to about 60 weight percent of polymethyl methacrylate and from about 40 to about 60 weight percent of vinylchloride/vinylacetate resin. This may optionally contain from about 5 to about 15 weight percent of a wax (such as polyethylene wax). These materials collectively comprise the "binder."

Referring again to FIG. 1, and in the preferred embodiment described therein, in addition to the binder the opacifying layer 16 may also comprise metallic reflective particles. As used herein, the term "metallic" includes a material in its elemental form, which is commonly referred to as a metal, including elements from Groups 4A through IB of the periodic table. Thus, e.g., one may use aluminum, tin, copper, bronze, brass, one or more transition metal elements, silver, gold, lead, gallium, indium, and the like.

It is preferred to use a metal selected from the group consisting of aluminum, copper, tin, zinc, alloys thereof, and mixtures thereof. The metallic material in the opacifying layer 16 is preferably present in a concentration of from about 5 to about 90 weight percent, by dry weight. Some of the more preferred metallic materials are illustrated in FIGS. 2, 3, and 4.

Figure 2:
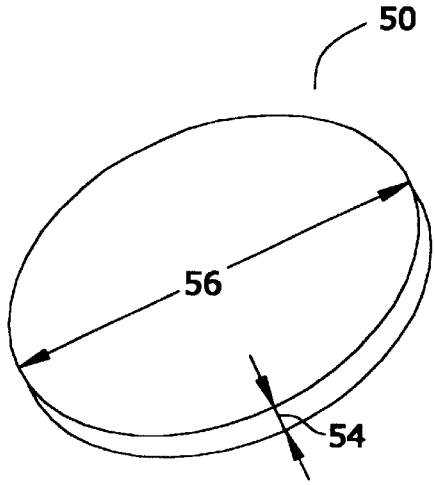
FIG. 2 is a perspective view of one preferred reflective particle used in the opacification layer of the ribbon of FIG. 1.

FIG. 2 is a perspective view of a preferred particle 50 of aluminum which is present in a "silver dollar" morphology. Aluminum material with this morphology is sold by Eckart America Corporation of Painesville, Ohio as "Metallux 2196 aluminum." This material is substantially non-leafing (i.e., after being coated onto the pigmented layer 14 and being dried, the aluminum does not rise to the surface and form a flat, reflective layer.) The aspect ratio of this particle 50, i.e., the ratio of its largest dimension 52 to its smallest dimension, is substantially greater than 2.0 and preferably is at least 10/1.

Figure 3:
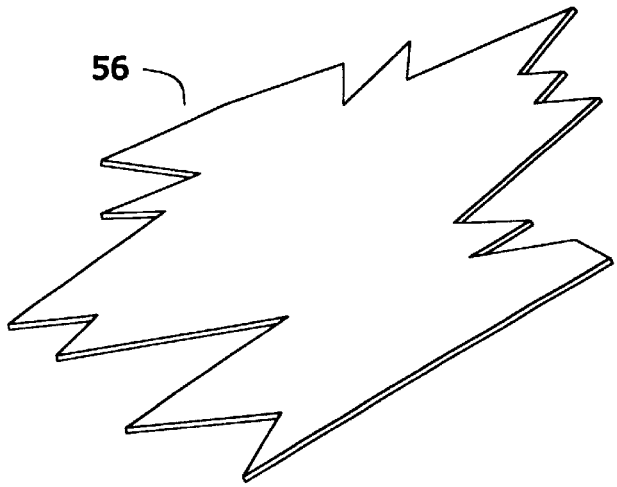
FIG. 3 is a perspective view of another preferred reflective particle used in the opacification layer of the ribbon of FIG. 1.
Figure 4:
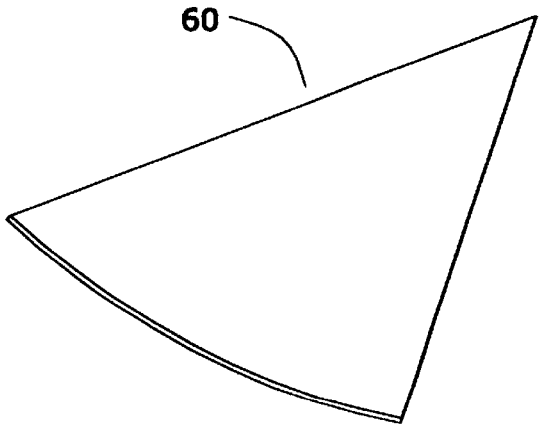
FIG. 4 is a perspective view of yet another preferred reflective particle used in the opacification layer of the ribbon of FIG. 1.

FIG. 3 is a perspective view of a particle 56 with a "cornflake" morphology which, as will be apparent, also has an aspect ratio in excess of 2.0. The Eckart America Corporation sells "Chromal 1 Aluminum," which has a thickness of 1.5 microns, a maximum dimension of 27 microns, and an area of about 572 square microns. This material is also non-leafing and has the cornflake morphology.

The Eckart America Corporation also sells "PCR507," which has the cornflake morphology, a thickness of about 1 micron, a maximum dimension of 21 microns, and an area of about 346 square microns. This material is also non-leafing.

Additionally, the Eckart America Corporation sells "Rotosafe Bronze," which is an alloy of copper, which has a thickness of 1 micron, which has the cornflake morphology, which has a maximum dimension of 21 microns, and which has an area of 113 square microns. This material is leafing, but it can be used to advantage in the ribbon 10 of this invention.

The Eckart Corporation also sells "Rotosafe Aluminum," which also has the cornflake morphology, a thickness of 1 micron, a maximum dimension of 12 microns, and an area of 113 square microns. This material also is leafing.

FIG. 4 is a perspective view of a vapor deposited aluminum particle 60, which is a vapor deposited platelet of aluminum. The material used to produce this platelet is sold by the Eckart America Corporation as "Metalure L56161 Aluminum"; and, after its deposition, it is non-leafing. Like the other particles described in the Figures, particle 60 has an aspect ratio substantially greater than 2.0.

The opacification layer 16 has a transmission density of at least about 0.2 and, preferably, at least about 1.0. Unlike other prior art layers, it is capable not only of reflecting light but also of adhering to a printable substate when subjected to a temperature in the range of from about 150 to about 400 degrees Celsius. Applicants are not aware of any other opacification layer in the prior art of thermal ribbons which advantageously combines these functions.

The advantages of applicants' thermal ribbon 10 can readily be demonstrated by using the methodology of A.S.T.M. Standard Test D2805-96A. Rather than coating over a black and white substrate by hand draw down, as described in A.S.T.M. D2805-96A, the layers on the thermal transfer ribbon substrate 12 opposite to the coating 20 are printed onto those substrates by a thermal transfer printer. Printers such as the 14ϕxiII (Zebra Technologies Corporation, Vernon Hills, Ill.), Edge or Edge II (Gerber Scientific Inc., South Windsor, Conn.), or the CB416 (TEC) can be used. The black and white substrates that are printed and measured can be cast or calendared vinyls, such as Mac Tac 9800, or Scotchcal 220 (available from the Minnesota Mining and Manufacturing Company of St. Paul, Minn.). The measurements and calculations are then carried out in accordance with the A.S.T.M. test. In the examples set forth in this specification, a Zebra 14ϕxiII printer, Scotchcal 220 matte vinyls and a DCI Spectra flash SF600 were used. If one calculates the contrast ratio of the printable substrate produced by the thermal ribbon 10 of this invention in accordance with the method of such A.S.T.M. test, it will be discovered that such contrast ratio is always at least 90 percent.

Figure 5:
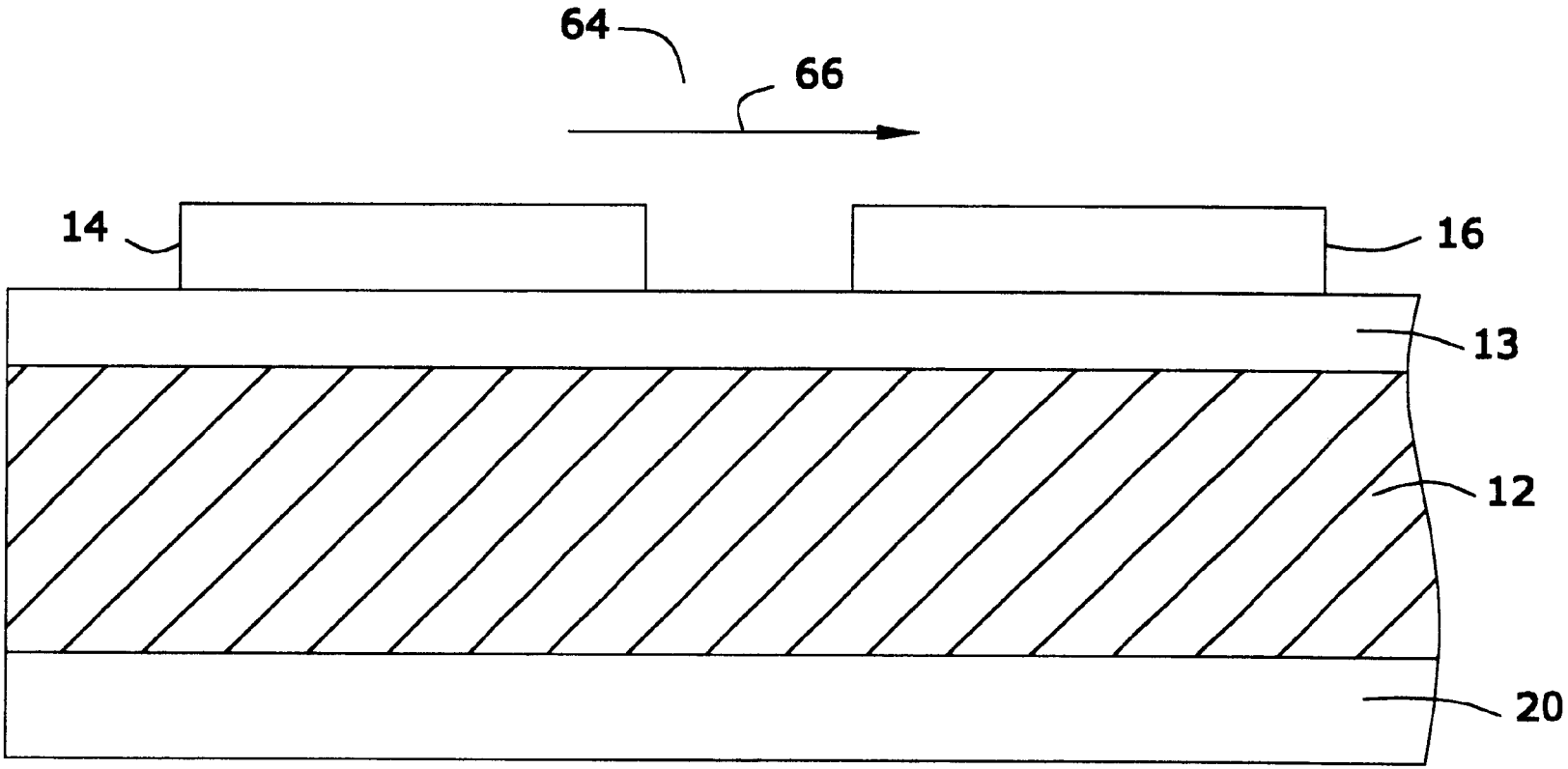
FIG. 5 is a sectional view of another preferred thermal ribbon of this invention.

FIG. 5 is a sectional view of layered thermal ribbon 64 comprised of adjacent layers 14 and 16. As will be apparent, the ribbon 64 is moving in the direction of arrow 66; thus, the printable surface contacts opacification layer 16 first and pigmented layer 14 second. In one embodiment, not shown, the printable substrate is wrapped around a platen drum which allows re-registration of the sequential printing passes.

Figure 6:
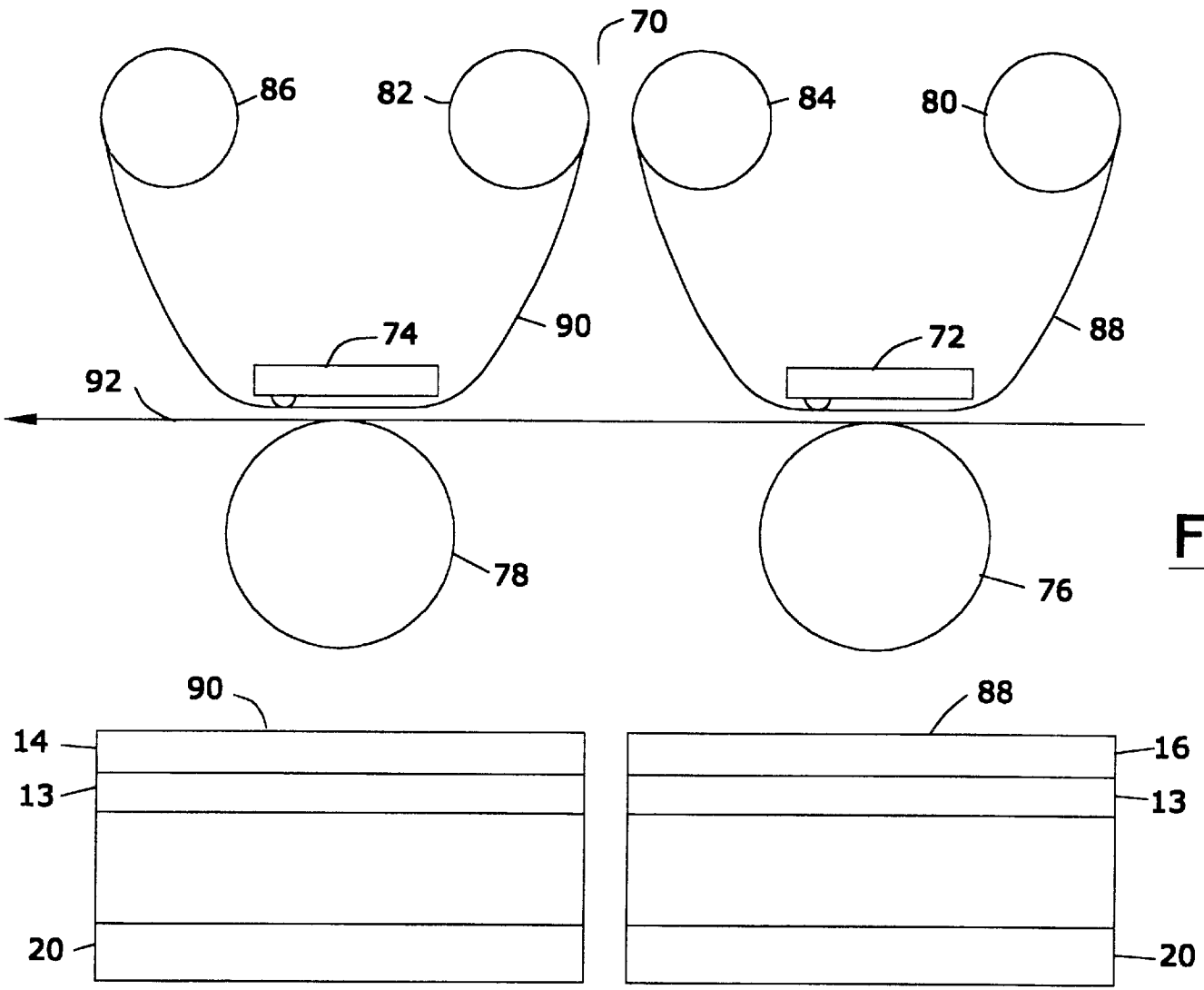
FIG. 6 is a sectional view of a ribbon assembly comprised of a multiplicity of ribbons.

FIG. 6 is a schematic representation of a two-station thermal transfer printer 70 which is comprised of print heads 72 and 74, platen rollers 76 and 78, ribbon supply spools 80 and 82, ribbon rewind spools 84 and 86, ribbons 88 and 90, and means for rotating spools 76, 78, 80, 82, 84, and 86 (not shown). The printable substrate (not shown) is fed in the direction of arrow 92. It first contacts opacification layer 16 on ribbon 88, and then it contacts pigmented layer 14 on ribbon 90.

Another Preferred Embodiment of the Invention

In the embodiment depicted in FIGS. 7 and 8, the coatings on the side of substrate 12 opposite the coated layer 20 are comprised of from about 0.5 to about 20 weight percent of glass particles. Applicants have discovered that the use of such glass particles unexpectedly allows one to obtain the desired degree of opacity without either having to endure chalkiness of unduly heavy pigment layers.

The glass used in this thermal ribbon may be substantially any glass. Thus, e.g., one may use glass frit, soda lime glass, borosilicate glass, metallized glass particles, fiberglass, etc.

Thus, by way of illustration and not limitation, one may use glass particles sold by the American Porcelain Enamel Company of Muskegon, Mich. as product "9630 Flux." When using such glass particles, it is preferred to comminute them until at least about 95 weight percent of their particles are less than about 15 microns. In one preferred embodiment, at least about 90 weight percent of the glass particles are less than about 5 microns.

By way of further illustration, one may use glass particles sold by the Mo-SCI Corporation of 4000 Enterprise Drive, Rolla, Mo. Thus, e.g., one may use the "MetaSPERES" or the "ACCUSPERHES" glass particles sold by such company. The MetaSPHERES are metal-coated glass particles, and the ACCUSPHERES are not metal coated; both are preferably alkali-free borosilicate glasses. By way of further illustration, one may use one or more of the specialty glass fibers sold by such company. Regardless of the form of the glass used, it is preferred that its maximum particle dimension be less than about 15 microns.

The glass particles used in the composition of this invention preferably have a refractive index of at least about 1.4. In one embodiment, the refractive index of these glass particles is at least about 2.0. In another embodiment, the refractive index of these glass particles is at least about 2.3.

The glass particles may be disposed in one more layers of the ribbon. Whichever layer or layers of the ribbon the glass particles are so disposed in, it should be substantially homogeneously dispersed therein.

The glass used in the process if this invention is preferably achromatic. The term achromatic, as used in this specification, refers to a glass which does not affect visible light impacting it so that such visible light shows no color to the eyes of a viewer.

Without wishing to be bound to any particular theory, applicants believe that, in one embodiment, the glass particles have a sufficiently small particle size so that, even if they do diffract or refract visible light, the cumulative effect of all such particles is to present the appearance of white light to a viewer. Such particles are "achromatic" as this term is used in the specification.

Applicants have discovered that the use of both glass and rutile titanium dioxide in their ribbon produces a synergistic effect. When the glass is used without any titanium dioxide, at a concentration from 5 to 90 weight percent and a coating weight of approximately 8 grams per square meter, the images printed will have a contrast ratio of no greater than about 5 percent. When rutile titania is used by itself, at a concentration of 72 percent and a coat weight of about 8 grams per square meter coverage, one cannot obtain a contrast ratio of greater than about 85 percent. When, however, one uses both glass (at concentration of about 5 weight percent) and rutile (at a concentration of about 72 weight percent), one obtains a contrast ratio of from about 87 to about 91 percent without inducing chalkiness in the ribbon or printed image. With this preferred formulation, there is no color shift, and the thermal ribbon appears to be white to a viewer.

By comparison, if one substitutes mica for glass in the aforementioned formulation, at the same concentration, the contrast ratio does not improve and, in some cases, decreases. This is a rather unexpected development in that the mica, in its natural state, has a white color.

By way of further comparison, if one uses aluminum flakes instead of the glass in the thermal ribbon, one will obtain contrast ratios of up to 100 percent. However, one will also have a color shift in the ribbon such that the ribbon appears to a grey color.

In one embodiment, not shown, one may substitute for some of all of the glass particles other particles with similar properties, such as similar dimensions, similar transparencies, similar refractive indices, and similar "achromicities" as the glass particles. Thus, by way of illustration and not limitation, one may replace some or all of the glass particles with similar particles of acrylics, acrylic copolymers, polycarbonate, polyesters, copolyesters, polystyrenes, copolymers of polystyrene, and the like.

The contrast ratio of a ribbon, and the degree to which it appears to be white, may be measured by standard techniques. The test for determining contrast ratio is discussed elsewhere in this specification; see, A.S.T.M. Test D2805-96A.

The test for determining whiteness is carried out according to the standard ISO R 457 Test Procedure Again, the measurements are taken on samples printed onto black and white substrates rather than coated onto the substrates. One may use, e.g., a Datacolor Elephro 2000 instrument, Lighting Unit D65 at 10 degrees, for example, to make the measurements.

In general, the whiteness of the thermal ribbon is measured in accordance with the aforementioned ISO R 457 test protocol. In accordance with ASTM Test D2805-96A, the thermal ribbon is used to print onto both black and white substrates. Thereafter, the black and white substrates are evaluated using the ISO-R-457 protocol but utilizing a using a 525 nanometer centered source. Thereafter, in accordance with the ISO-R-457 protocol, the brightness of the sample is calculated.

The thermal ribbon of this invention preferably has a brightness of at least about 70 percent and a contrast ratio of at least 87 percent. It is preferred that the brightness of the ribbon be at least about 75 percent. In one embodiment, the contrast ratio is at least about 89 percent.

Figure 7A:
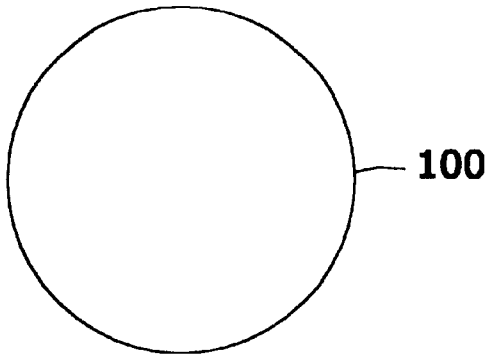
FIGS. 7A, 7B, and 7C are schematic representations of the types of glass particles which are preferably used in applicants' ribbon depicted in FIGS. 8A, 8B, and 8C.
Figure 7B:
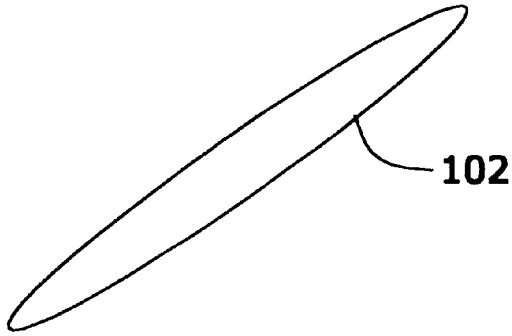
Figure 7C:
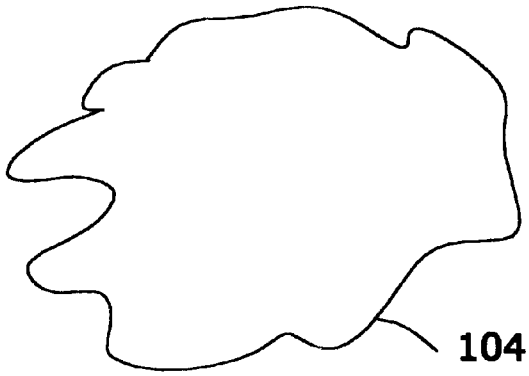

FIGS. 7A, 7B, and 7C illustrate some of the cross-sectional shapes of the glass which may be used in the process of this invention. Thus, by way of illustration and not limitation, glass particle 100 may have a substantially circular cross-sectional shape. In one embodiment, glass particle 100 has a transmittance of at least about 5 percent. As used in this specification, the term transmittance refers to the ratio of the radiant power transmitted by glass particle 100 to the radiant power incident upon such glass particle 100.

Referring to FIG. 7B, a rod-shaped glass particle 102 is illustrated. In this embodiment, it is preferred that the aspect ratio of glass particle 102 (the ratio of its length to its width) be from 1.1 to about 3.0.

FIG. 7C illustrates an irregularly shaped glass particle 104. As is known to those skilled in the art, many glass frits have the cross-sectional shape depicted in FIG. 7C.

Figure 8A:
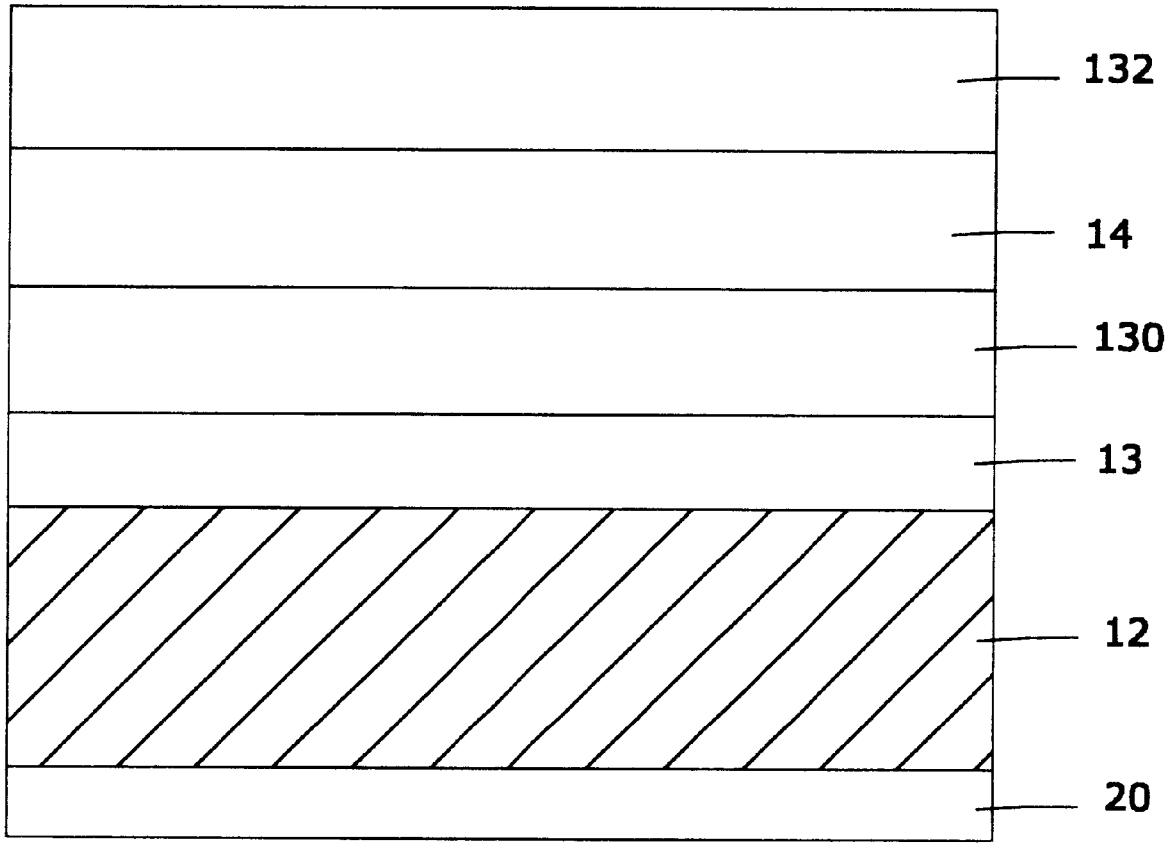
FIGS. 8A, 8B, and 8C are schematic illustrations of three different preferred embodiments of applicants' invention.
Figure 8B:
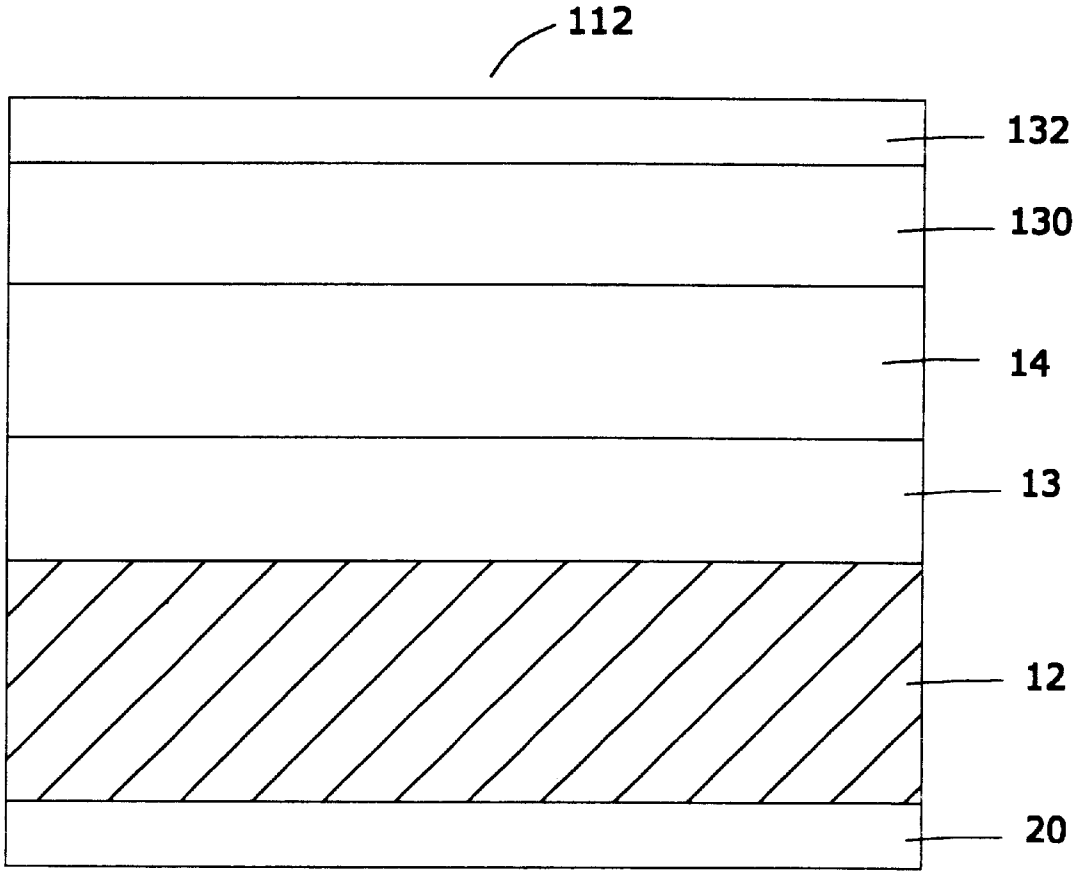
Figure 8C:
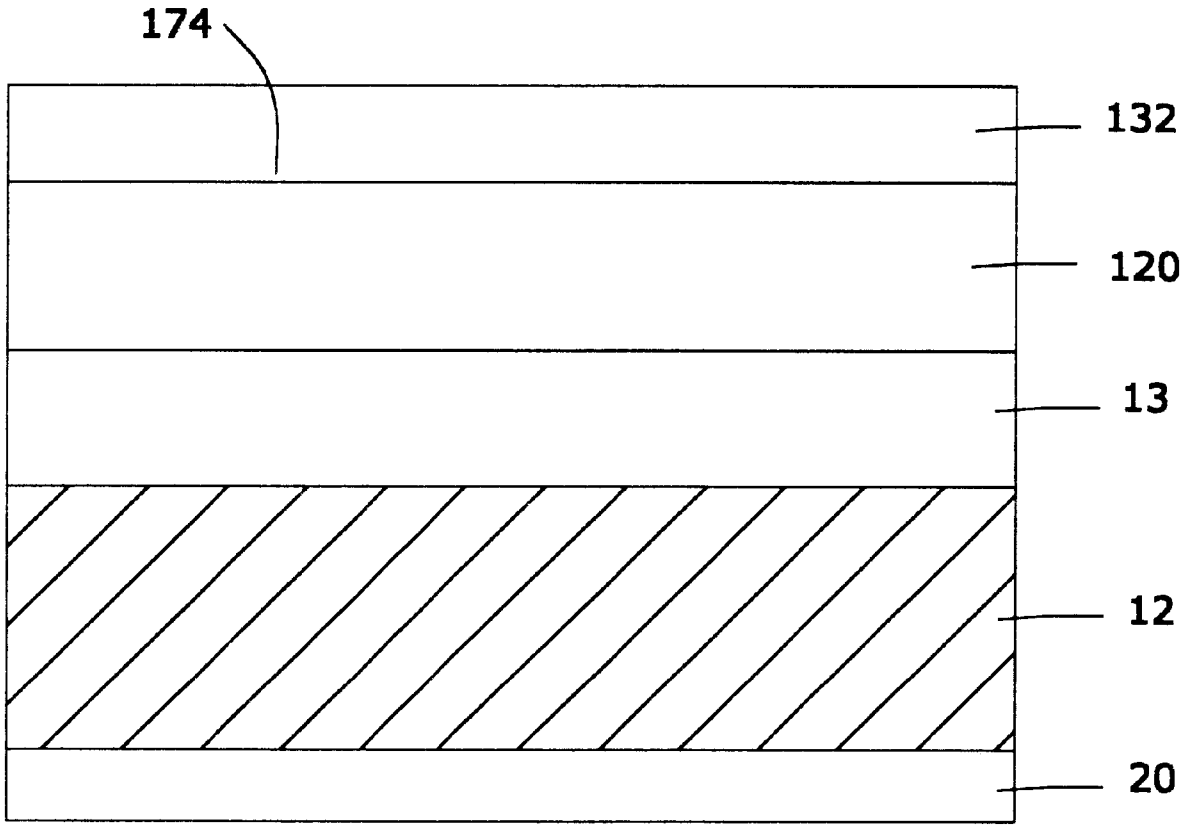

FIGS. 8A, 8B, and 8C depict preferred ribbons 110, 112, and 114 which are similar in some respects to the ribbon 10 (see FIG. 1) but differ therefrom.

Each of the coatings disposed on substrate 12 on the side opposite to layer 20, 110, 112, and 114 is comprised of from about 45 to about 85 weight percent of titanium dioxide. It is preferred that the titanium dioxide be in particulate form and that at least about 95 weight percent of the titanium dioxide particles have a particle size in the range of from about 0.15 to about 1.0 microns. In one embodiment, at least about 95 weight percent of the titanium dioxide particles have a particle size of from about 0.15 to about 0.3 microns.

In one embodiment, the titanium dioxide particles used are rutile titanium dioxide particles. As is known to those skilled in the art, rutile has a hardness of from about 6 to about 6.5, a density of about 4.3, a melting point of about 1640 degrees Centigrade, and a refractive index of about 2.7.

In another embodiment, the titanium dioxide particles used have an anatase crystal structure.

In one embodiment, the titanium dioxide particles are coated. Reference may be had, e.g., to U.S. Pat. Nos. 6,114,079, 6,086,668, 5,962,082, 5,922,120, 5,628,932, 5,585,037, 5,236,737, 5,178,736, 5,104,583, 4,093,432, and the like. The entire disclosure of each of these United States patents is hereby incorporated by reference into this specification.

By way of further illustration, one may use "Ti-Pure," a coated titania sold by the E.I. duPont deNemours arnd Compariy of Wilmington, Del. as product R-931. The product contains 80 weight percent of titania, 10.2 weight percent of silica, and 6.4 weight percent of alumina.

Referring again to FIG. 8A, and also to FIG. 8B, the titania particles are preferably homogeneously dispersed within layer 14. This layer 14 is substantially similar in composition to the layer 14 described with reference to, e.g., FIG. 1.

In FIG. 8C, the titania is preferably disposed within layer 120, which will be described in more detail later in this specification.

Referring again to FIG. 8A, layer 130 is comprised of the aforementioned glass particles. In the embodiment depicted, layer 130 has a coating weight of from about 0.1 to about 10 grams per square meter and a glass content of from about 5 to about 95 weight percent. In one embodiment, layer 130 contains from about 70 to about 90 weight percent of glass.

In one embodiment, and referring again to FIG. 8A, the total coating weight of layers 14 and 130 does not exceed about 20 grams per square meter and, preferably, 15 grams per square meter.

Referring again to FIG. 8A, and in the embodiment depicted, optional layers 13 and 132 may, but need not, be utilized. Optional layer 13 is a release layer, and it has been described elsewhere in this specification.

Optional layer 132 is an adhesion promotion layer. It is present at a coating weight of from about 0.1 to about 5 grams per square meter; the preferred coating weight for this layer is from about 0.5 to 2.0 grams per square meter. Layer 132, preferably comprises from about 0 to about 100 weight percent of a thermoplastic resin, and from about 0 to about 100 weight percent of wax. Layer 132 is adapted to adhere to a receiver when it is heated to a temperature of above about 50 degrees Centigrade and contacted with the receiver. It is preferred that the adhesion promotion layer contain either the aforementioned wax and/or the aforementioned resin.

In the embodiment depicted in FIG. 8A, 5 layers of material are disposed over or under substrate 12. In another embodiment, layer 132 is omitted. In another embodiment, both layer 13 and layer 132 are omitted.

FIG. 8B illustrates a ribbon 112 which is similar to the ribbon 110 with the exceptions that the layers 13, 14, 130, and 132 are disposed in different positions. Similarly, FIG. 8C illustrates a ribbon 114 which is also similar to ribbon 110 but differs therefrom in that it contains a layer 120 which differs from the layers on the other ribbons.

Layer 120 preferably has a coating weight of from about 2 to about 15 grams per square meter and, more preferably, from about 5 to about 10 grams per square meter. This layer 120 is comprised of both the aforementioned titania particles, and the aforementioned glass particles. It may also be comprised of a one or more of the binders described elsewhere in this specification.

Layer 120 preferably comprises from about 10 to about 30 weight percent of such binder, and from about 70 to about 90 weight percent of a mixture of said glass and titania particles. The glass particles are present within layer 120 at a weight of from about 2 to about 20 weight percent, by total weight of layer 120; it is preferred that the glass within layer 120 comprise from about 5 to about 10 weight percent of such layer. The titania particles are present within layer 120 at a weight of from about 8 to about 85 weight percent of said layer. Layer 120 may optionally comprise from about 0 to 15 weight percent of one or more plasticizing agent, from about 0 to about 5 weight percent of one or more dispersing agents, and minor amounts of other optional agents, such as extenders, optical brigheteners, leveling agents, rheology modifying agents, tackifiers, etc.

In one embodiment, the layer 120 has porosity of from about 1 to about 20 volume percent. One may introduce controlled amounts of porosity into layer 120 by bubbling air into it before it sets. Alternatively, or additionally, one may mix air into the coating composition before applying it. One also, e.g., may induce porosity after the coating composition has been applied with an aerating agent.

The following examples are presented to illustrate the claimed invention but are not to be deemed limitative thereof. Unless otherwise specified, all parts are by weight, and all temperatures are in degrees Celsius.

In these examples, thermal transfer ribbons similar in construction to those depicted in FIGS. 1, 8A, 8B, and 8C were made. The substrate (12) used was poly(ethylene terephthalate) film which was 4.5 microns thick.

In these examples, a "solution A" and a "solution B" were utilized.

The "solution A" was made by mixing 34.15 grams of solvent-grade 2-butanone and 34.15 grams of solvent-grade toluene and heating the mixture to a temperature of 70° C. After reaching temperature, 26.56 grams of Vitel 2200 linear saturated polyester resin (purchased from Bostik Inc. of 211 Boston Street, Middleton, Mass.) and 5.15 grams of Dynapol L411 copolyester resin (purchased from Creanova Inc. of Turner Place, Box 365, Piscatannay, N.J.) were added and stirred until they were completely dissolved, and the mixture was then cooled to room temperature.

The solution "B" was made by mixing 43.99 grams of solvent-grade 2-butanone and 24.3 grams of solvent-grade toluene and heating to 70° C. After reaching this temperature, 1.98 grams of Atlac 382 ES, a bisphenol-A fumarate polyester (purchased from Reichhold Chemical, Triangle Research Park, N.C.) and 29.73 grams of Dianal; BR87 (CAS #25086-15-1) polymethylmethacrylate (purchased from Dianal America Corporation) were added and stirred until they were completely dissolved, and the mixture was then allowed to cool to room temperature.

COMPARATIVE EXAMPLE 1

A coating (120) was prepared by mixing 7.76 grams of solution "A", 31.01 grams of solution "B", 6.27 grams of solvent-grade 2-butanone, and 5.51 grams of solvent-grade toluene. Thereafter, 0.42 grams of Solsperse 24000 dispersant (a nonionic dispersant of polyamine polyester polymer purchased from Avecia Inc., 8720 Red Oak Blvd., Suite 227, Charlotte, N.C.) and 35.19 grams of approximately 0.35-micron particle size rutile titanium dioxide RCL3 (purchased from Millennium Chemicals of Baltimore, Md.) were added. After mixing to reach a stable dispersion, there were added 9.58 grams of High Flat X7328 oxidized polyethylene wax dispersion (CAS #31069-12-2, purchased from the Gifuseratsuku Company of Japan), 3.87 grams of solvent-grade xylene, and 0.38 grams of Admex 412 plasticizer (hexamedioic acid polymer with 12-proanediol, 2-ethyl hexyl ester, CAS #68238-77, purchased from Velsicol). The mixture was mixed until homogenous.

The coating (120) so prepared was coated onto the polyester substrate (12) by means of a Mayer rod coating bar, sufficient to yield a dry weight of 7.5 grams per square meter. The coated polyester substrate was then dried with a hot air gun for one minute until it contained less than about 1 percent of solvent.

In a similar manner, backcoating layer (20) was prepared and applied to the opposite side of the polyester substrate at a coat weight of 0.05 grams per square meter. This backcoating (20) used was polydimethylsiloxane-urethane copolymer sold as "SP-2200" cross-linked with "D70" toluene diisocyanate-based prepolymer (CAS #31370-61-3), both of which are sold by the Advanced Polymer Company of Park 80 West, Plaza One, Saddlebrook, N.J.

The ribbons produced in this Example were evaluated using a Zebra 170 XI printer to print images onto glossy black and white Gerber Scotchcal vinyl receivers. The printer energy was adjusted until the test quality printed was optimized. Print quality testing included the evaluation of the opacity of the images, in substantial accordance with the procedure described in A.S.T.M. test D2805-96A. The printed substrate on vinyl had opacity over black of 83.23% and brightness over black of 65.72.

COMPARATIVE EXAMPLE 2

The procedure of Example 1 was substantially followed with the exception that the ribbon produced contained an opacification layer (16). The opacification layer (16) was made by mixing 2.67 grams of solution "A", 10.68 grams of solution "B", 2.52 grams of solvent-grade 2-butanone, and 2.22 grams of solvent-grade toluene. To this mixture were added 6.94 grams of Metalure L56161 (a vapor-deposited aluminum particle which is described elsewhere in this specification and which was purchased from the Eckart America Corporation). After mixing to reach a stable dispersion, there were added 3.30 grams of High Flat X7328 polyethylene wax dispersion, 1.56 grams of solvent-grade xylene, and 0.13 grams of Admex 412 plasticizer (purchased from Velsicol). The mixture was mixed until homogenous.

After coating the aforementioned titanium pigmented layer at the coat weight used in Comparative Example 1, the dried assembly was then coated with layer (16), the opacification layer described in the preceding paragraph, using the same Mayer rod coating method at a coat weight of 1.0 grams per square meter.

The coated substrate was then dried with a hot air gun for one minute until it contained less than about 1 percent solvent.

The printed receiver had opacity over black of 99.9% and brightness over black of 66.49.

EXAMPLE 3

The procedure of Example 1 was substantially followed. A coating (120) was prepared by mixing 6.14 grams of solution "A", 24.54 grams of solution "B", 0.68 grams of solvent-grade 2-butanone, and 9.55 grams of solvent-grade toluene. Thereafter there were added 0.34 grams of Solsperse 24000 dispersant (purchased from Avecia Inc.), 33.5 grams of 0.35-micron particle size rutile titanium dioxide (purchased from Millennium Chemicals Company of Baltimore, Md.) and 5.0 grams 9630 Flux (purchased from American Porcelain Enamel Company of Muskegon, Mich.). After mixing to reach a stable dispersion, added were 7.58 grams of X7328 polyethylene wax dispersion (purchased from the Gifu Shellac Manufacturing Company Ltd of Japan), 12.38 grams of solvent-grade xylene, and 0.30 grams Admex 412 plasticizer (purchased from Velsicol). The mixture was mixed until homogenous. The solution was coated, dried, and printed as described in Comparative Example 1.

The printed receiver had opacity over black of 87.91% and brightness over black of 72.71.

EXAMPLE 4

The procedure of Example 3 was substantially followed. The coating 120 was prepared by mixing 6.12 grams of solution "A", 24.48 grams of solution "B", 0.73 grams of solvent-grade 2-butanone, and 9.57 grams of solvent-grade toluene. Then added were 0.36 grams of Solsperse 24000 dispersant (purchased from Avecia Pigments and Additives, USA Division), 36:0 grams of 0.35-micron particle size rutile titanium dioxide (purchased from Millennium Chemicals of Baltimore, Md.) and 2.5 grams of 9630 Flux (purchased from American Porcelain Enamel. Company of Muskegon, Mich.). After mixing to reach a stable dispersion, there were added 7.56 grams of X7328 polyethylene wax (purchased from Gifuseratsuku Company of Japan), 12.38 grams of solvent-grade xylene, and 0.30 grams of Admex 412 plasticizer (purchased from Velsicol). The mixture was mixed until homogenous. The solution was coated, dried, and printed in accordance with the procedure described for Comparative Example 1.

The printed substrate had opacity over black of 87.30% and brightness over black of 72.13.

EXAMPLE 5

The procedure of Comparative Example 2 was substantially followed with the exception that a glass containing layer (130) was substituted for the opacification layer, and the glass-containing layer was made by mixing 0.82 grams of solution "A", 3.30 grams of solution "B", 0.41 grams of solvent-grade 2-butanone, and 1.56 grams of solvent-grade toluene. To this mixture were added 6.0 grams of 9630 Flux (purchased from American Porcelain Enamel Company of Muskegon, Mich.). After mixing to reach a stable dispersion, there were added 1.02 grams X7328 polyethylene wax (purchased from Gifuseratsuku Company of Japan), 1.86 grams of solvent-grade xylene, and 0.04 grams Admex 412 plasticizer (purchased from Velsicol). The mixture was mixed until homogenous.

After coating the titanium pigmented layer, the dried assembly was then coated with layer (130), the glass-containing layer, using the same Mayer rod coating method at a coat weight of 0.5 grams per square meter. The coated substrate was then dried with a hot air gun for one minute until it contained less than about 1 percent solvent. The printed substrate had opacity over black of 86.98% and brightness over black of 71.37.

EXAMPLE 6

The procedure of Example 5 was substantially followed with the exception that its glass-containing layer (130) was coated first and dried and the titanium pigmented layer (14) was coated and dried on top of glass-containing layer (130). The printed substrate had opacity over black of 90.95% and brightness over black of 76.21.

EXAMPLE 7

The procedure of Example 6 was substantially followed. The titanium pigmented layer 14 was prepared by mixing 6.66 grams of solution "A", 26.65 grams of solution "B", and 8.85 grams of solvent-grade toluene. To this mixture were added 0.38 grams of Solsperse 24000 dispersant and 37.5 grams of 0.35-micron particle size rutile titanium dioxide (purchased from Millennium Chemicals of Baltimore, Md.). After mixing to reach a stable dispersion, added were 8.23 grams of X7328 polyethylene wax dispersion (purchased from Gifuseratsuku Company of Japan), 12.38 grams of solvent-grade xylene, and 0.33 grams Admex 412 plasticizer (purchased from Velsicol). The mixture was mixed until homogenous. The solution was dried, coated, and printed in substantial accordance with the procedure of Example 1.

The printed substrate had opacity over black of 88.19% and brightness over black of 71.7.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

We claim:

1. A thermal transfer ribbon with an effective contrast ratio of at least about 87 percent and a brightness of at least about 70, wherein said thermal transfer ribbon is comprised of a flexible substrate and, disposed over said substrate, at least one coating comprised of from about 45 to about 90 weight percent of titania with a particle size of from about 0.1 to about 1.0 micron and from about 0.05 to about 20 weight percent of glass particles and having a coat weight from about 3 to about 20 grams per square meter.

2. The thermal transfer ribbon as recited in claim 1, wherein said titania is rutile titanium dioxide.

3. The thermal transfer ribbon as recited in claim 2, wherein at least about 90% of said titanium dioxide particles are smaller than about 0.7 microns.

4. The thermal transfer ribbon as recited in claim 3, wherein said coating is comprised of from about 70 percent to about 85 percent titanium dioxide.

5. The thermal transfer ribbon as recited in claim 4, wherein at least about 90 weight percent of said glass particles are smaller than about 5 microns.

6. The thermal transfer ribbon as recited in claim 5, wherein said coating has a coat weight of from about 5 to about 10 grams per square meter.

7. The thermal ribbon as recited in claim 4, wherein at least about 95 weight percent of said titanium dioxide is titanium dioxide particles with a particle size in the range of from about 0.15 to about 0.3 microns.

8. The thermal ribbon as recited in claim 7, wherein said titanium dioxide particles are coated titanium dioxide particles.

9. The thermal ribbon as recited in claim 1, wherein said thermal transfer ribbon is comprised of a release layer.

10. The thermal transfer ribbon as recited in claim 9, wherein said release layer is disposed between said flexible substrate and said coating.

11. A thermal transfer ribbon with an effective contrast ratio of at least about 87 percent and a brightness of at least about 70, wherein said thermal transfer ribbon is comprised of a flexible substrate and, disposed over said substrate, at least two coatings, one of which is comprised of from about 45 to about 90 weight percent of titania with a particle size of from about 0.1 to about 1.0 micron and has a coat weight between about 2 and 20 grams per square meter, and the second of which is comprised from about 10 to about 90 weight percent of glass particles and has a coat weight from about 0.1 to about 5 grams per square meter.

12. The thermal transfer ribbon as recited in claim 11, wherein said titania is rutile titanium dioxide.

13. The thermal transfer ribbon as recited in claim 12, wherein at least about 90% of said titanium dioxide particles are smaller than about 0.7 microns.

14. The thermal transfer ribbon as recited in claim 13, wherein said coating is comprised of from about 70 percent to about 85 percent titanium dioxide.

15. The thermal transfer ribbon as recited in claim 14, wherein at least about 90 weight percent of said glass particles are smaller than about 5 microns.

16. The thermal transfer ribbon as recited in claim 15, wherein said glass particle coating has a coat weight from about 0.3 to about 2 grams per square meter and said pigment layer has a coat weight from about 4 to about 10 grams per square meter.

17. The thermal transfer ribbon as recited in claim 16, wherein said glass coating has a glass content of from about 50 to about 90 weight percent.

18. The thermal ribbon as recited in claim 14, wherein at least about 95 weight of said titanium dioxide is titanium dioxide particles with a particle size in the range of from about 0.15 to about 0.3 microns.

19. The thermal ribbon as recited in claim 18, wherein said titanium dioxide particles are coated titanium dioxide particles.

20. The thermal ribbon as recited in claim 11, wherein said thermal transfer ribbon is comprised of a release layer.

21. The thermal transfer ribbon as recited in claim 20, wherein said release layer is disposed between said flexible substrate and said first coating.

22. The thermal transfer ribbon as recited in claim 11, wherein said glass containing layer is disposed between said flexible substrate and said pigment coating.

* * * * *